US009263809B2

(12) United States Patent
Assif et al.

(10) Patent No.: US 9,263,809 B2
(45) Date of Patent: Feb. 16, 2016

(54) TERMINAL BLOCK

(71) Applicant: CORNING OPTICAL COMMUNICATIONS WIRELESS LTD, Airport (IL)

(72) Inventors: Lior Assif, Petah Tikva (IL); Alon Rozenvax, Holon (IL); Shlomo Zilberman, Shoham (IL)

(73) Assignee: Corning Optical Communications Wireless Ltd, Airport City (IL)

( * ) Notice: Subject to any disclaimer, the term of this patent is extended or adjusted under 35 U.S.C. 154(b) by 0 days.

(21) Appl. No.: 14/520,918

(22) Filed: Oct. 22, 2014

(65) Prior Publication Data

US 2015/0118889 A1 Apr. 30, 2015

Related U.S. Application Data

(60) Provisional application No. 61/896,960, filed on Oct. 29, 2013.

(51) Int. Cl.

| | |
|---|---|
| ***H01R 4/52*** | (2006.01) |
| ***H01R 4/50*** | (2006.01) |
| ***H01R 9/24*** | (2006.01) |
| *H01R 4/40* | (2006.01) |
| *H01R 11/12* | (2006.01) |

(52) U.S. Cl.

CPC ..... *H01R 4/5008* (2013.01); *H01R 4/52* (2013.01); *H01R 9/24* (2013.01); *H01R 4/40* (2013.01); *H01R 11/12* (2013.01); *Y10T 29/49174* (2015.01)

(58) Field of Classification Search

CPC ..... H01R 4/5008; H01R 4/52; H01R 9/24; H01R 4/40; H01R 11/12; Y10T 29/49174

USPC ..... 439/727, 801, 811, 835, 372, 837, 838, 439/709, 711

See application file for complete search history.

(56) References Cited

U.S. PATENT DOCUMENTS

| | | | | |
|---|---|---|---|---|
| 264,299 | A | 9/1882 | Johnson | |
| 454,430 | A | 6/1891 | Greenfield | |
| 6,146,187 | A * | 11/2000 | Pallai | H01R 4/4836 439/431 |
| 7,011,551 | B2 | 3/2006 | Johansen et al. | 439/709 |
| 7,052,335 | B2 | 5/2006 | Matsuura et al. | 439/838 |
| 7,980,902 | B2 | 7/2011 | Capaldi-Tallon | 439/716 |
| 8,113,858 | B1 * | 2/2012 | Chiang | H01R 4/4845 439/188 |
| 2005/0159051 | A1 * | 7/2005 | Matsuura | H01R 4/5008 439/838 |
| 2006/0199444 | A1 * | 9/2006 | Germani | H01R 4/4827 439/835 |
| 2006/0228952 | A1 * | 10/2006 | Feldman | H01R 4/024 439/835 |
| 2008/0032566 | A1 * | 2/2008 | Walter | H01R 4/4836 439/721 |

(Continued)

FOREIGN PATENT DOCUMENTS

| | | | | |
|---|---|---|---|---|
| DE | 10114921 A1 | 10/2002 | | H01R 4/48 |
| EP | 2037536 B1 | 7/2008 | | H01R 12/53 |
| GB | 747630 | 4/1956 | | |

(Continued)

*Primary Examiner* — Abdullah Riyami
*Assistant Examiner* — Nelson R Burgos-Guntin
(74) *Attorney, Agent, or Firm* — C. Keith Montgomery

(57) ABSTRACT

A terminal block allows wires to be connected to the block by insertion at a front portion of the block and along a direction parallel to the length of the block. The block includes a securing feature to retain the electrical conductor securely in the block while also allowing simplified connection and disconnection of the wire.

20 Claims, 3 Drawing Sheets

(56) References Cited

U.S. PATENT DOCUMENTS

| | | | | |
|---|---|---|---|---|
| 2011/0223795 | A1* | 9/2011 | Schafmeister | H01R 4/4836 439/370 |
| 2015/0118889 | A1* | 4/2015 | Assif | H01R 4/5008 439/372 |

FOREIGN PATENT DOCUMENTS

| | | | | |
|---|---|---|---|---|
| JP | 1991037819 | B2 | 6/1991 | B22D 11/04 |
| JP | 2000268898 | A | 9/2000 | H01R 4/38 |
| KR | 887791 | B1 | 9/2007 | H01R 4/48 |

* cited by examiner

TERMINAL BLOCK

PRIORITY APPLICATION

This application claims the benefit of priority under 35 U.S.C. §119 of U.S. Provisional Application Ser. No. 61/896,960, filed on Oct. 29, 2013, the content of which is relied upon and incorporated herein by reference in its entirety.

BACKGROUND

The disclosure relates to electrical terminal blocks, and more particularly to methods and hardware adapted to efficient connection of electrical conductors with electrical terminal blocks.

FIG. 1 illustrates a conventional terminal block having front connection access. In this terminal block, an electrical conductor terminated by a ring lug is secured to the block by a screw. The terminal electrical conductor is held securely because the screw passes through the ring lug and actually threads into the block. Drawbacks to this solution are that the screws are loose and may become lost, and that the loose screws must be held and manually aligned with the ring lug while threading into the block. Another drawback is that the electrical conductor is difficult to connect in tight spaces because the electrical conductors extend perpendicular to the face of the terminal block. It is therefore difficult for a technician to hold the electrical conductor while at the same time holding a screwdriver and advancing a screw into the block.

FIG. 2 illustrates another conventional terminal block having front attachment access and in which the electrical conductor is aligned with the direction of insertion. In this example, the electrical conductor is inserted into an aperture, and a thread is advanced to press a plate against the exposed metallic conductor of the electrical conductor. The plate, however, holds the electrical conductor in the block by friction and the electrical conductor may disengage the block when the electrical conductor is in tension.

SUMMARY

One embodiment is addressed to a terminal block, comprising a housing having a front face, a receiving aperture at the front face adapted to receive a connection portion of a metallic conductor, an actuator member mounted in the housing so as to be translatable therein, a cam member mounted within the housing and configured to be pivoted about a pivot in response to translation of the actuator member, and a resilient member mounted within the housing and having a bias arm positioned to be moved toward and away from the connection portion of the conductor positioned within the receiving aperture. The resilient member may include a projection mounted on the bias arm configured to engage an aperture on the conductor positioned within the housing.

A further embodiment includes a method of connecting an electrical conductor having a connection portion to a terminal block comprising a housing, a receiving aperture adapted to receive the connection portion, an actuator member mounted in the housing so as to be translatable therein, a cam member configured to be pivoted about a pivot in response to translation of the actuator member, and a resilient member mounted within the housing and having a bias arm with a projection thereon. The conductor is inserted into the receiving aperture, and the actuator member is advanced through the housing, wherein the actuator pivots the cam member as the actuator advances, and the cam member moves the resilient member so that the projection engages an aperture in the connection portion to secure the electrical conductor in the terminal block.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1:
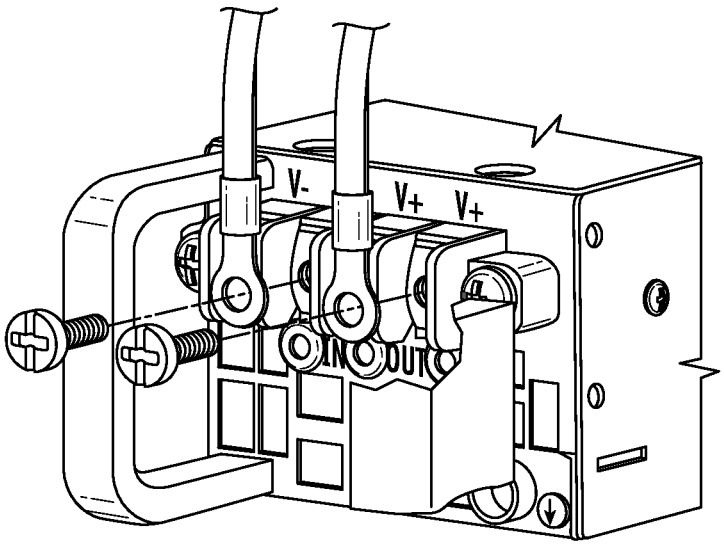
FIG. 1 illustrates a conventional terminal block having front connection access.
Figure 2:
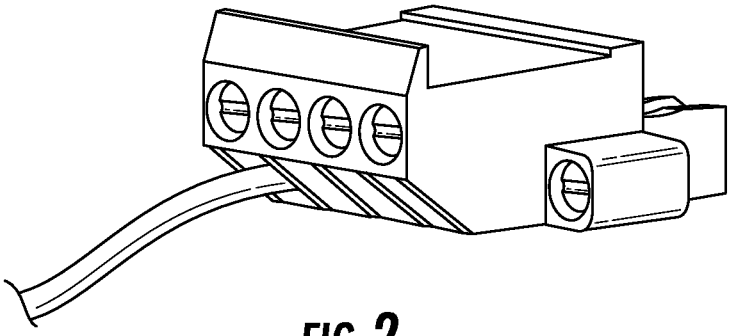
FIG. 2 illustrates a conventional terminal block having front connection access.

Reference will now be made in detail to the present preferred embodiment(s), examples of which are illustrated in the accompanying drawings. Whenever possible, the same reference numerals will be used throughout the drawings to refer to the same or like parts.

Figure 3B:
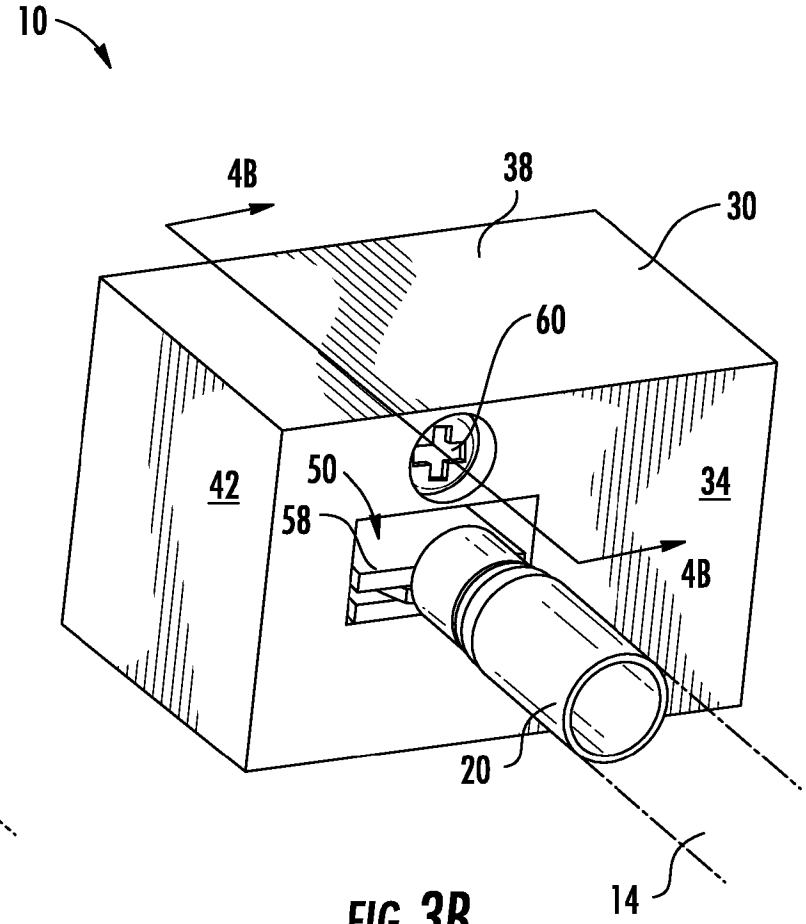
FIG. 3B illustrates the terminal block of FIG. 3A in which the electrical conductor is secured in the block.
Figure 3A:
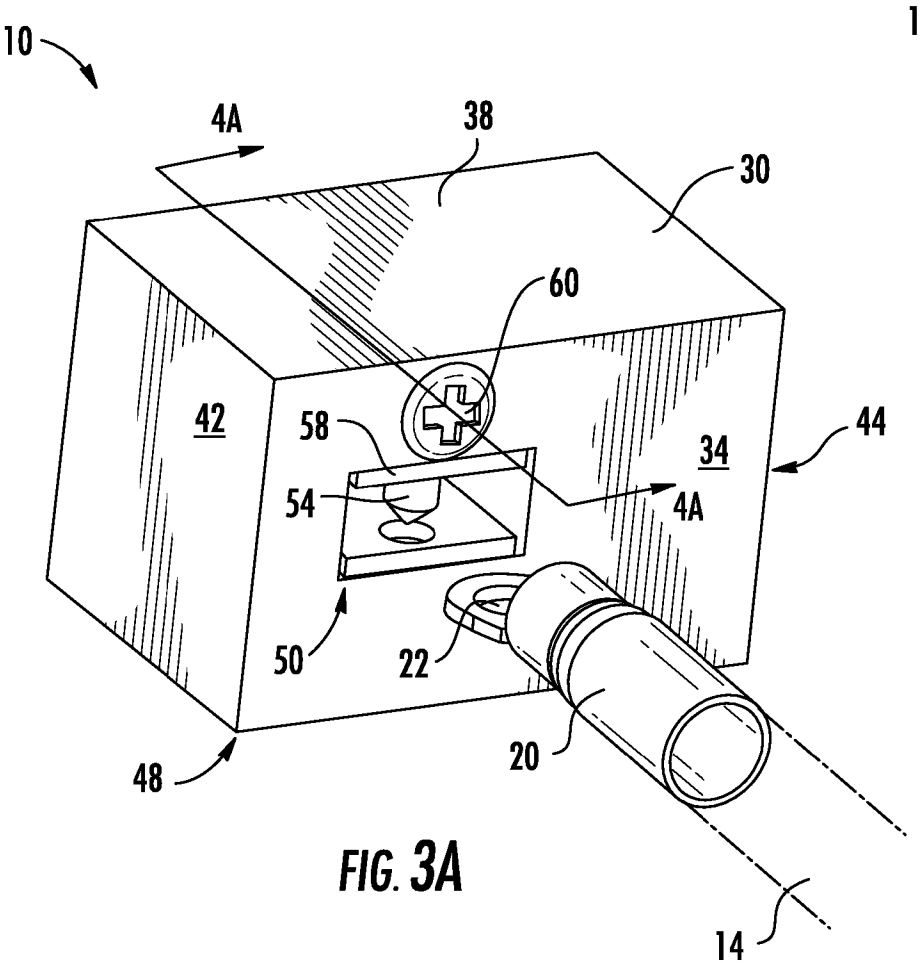
FIG. 3A illustrates a terminal block having front connection access according to a first embodiment in which an electrical conductor is not yet secured in the block.

FIG. 3A illustrates a terminal block 10 having front connection access according to a first embodiment. In FIG. 3A, an electrical conductor 14 is not yet secured in the block. The electrical conductor 14 is terminated at a connection portion 20 in the form of a ring lug having a lug aperture 22. The terminal block 10 has a housing 30 having a front face formed by a wall 34, a top wall 38, a first side wall 42, a second side wall 44 spaced from the first side wall 42, and a bottom wall 48. The walls 34, 38, 42, 44, 48 are illustrated as forming five sides of a parallelepipedal, generally rectangular six-sided solid, but one or more faces of the terminal block 10 may be oriented at relative angles of other than 90 degrees. A receiving aperture 50 in the front wall 34 receives the connection portion 20 for physically and electrically connecting the electrical conductor 14 to the terminal block 10.

A connection lug 54 is disposed within the housing 30 and serves to secure the ring lug 20 to the connection block 10. Referring to FIG. 3B, the connection lug 54 (shown in in FIG. 3A), is connected to a resilient spring arm 58 that deflects so as to position the connection lug 54 within the lug aperture 22. The spring arm 58 is deflected by turning a threaded actuator member 60 that is accessible at the front wall 34. The details of the terminal block 10 and the manner in which the electrical conductor 14 is connected to the block 10 are described in further detail below with reference to FIGS. 4A and 4B.

Figure 4B:
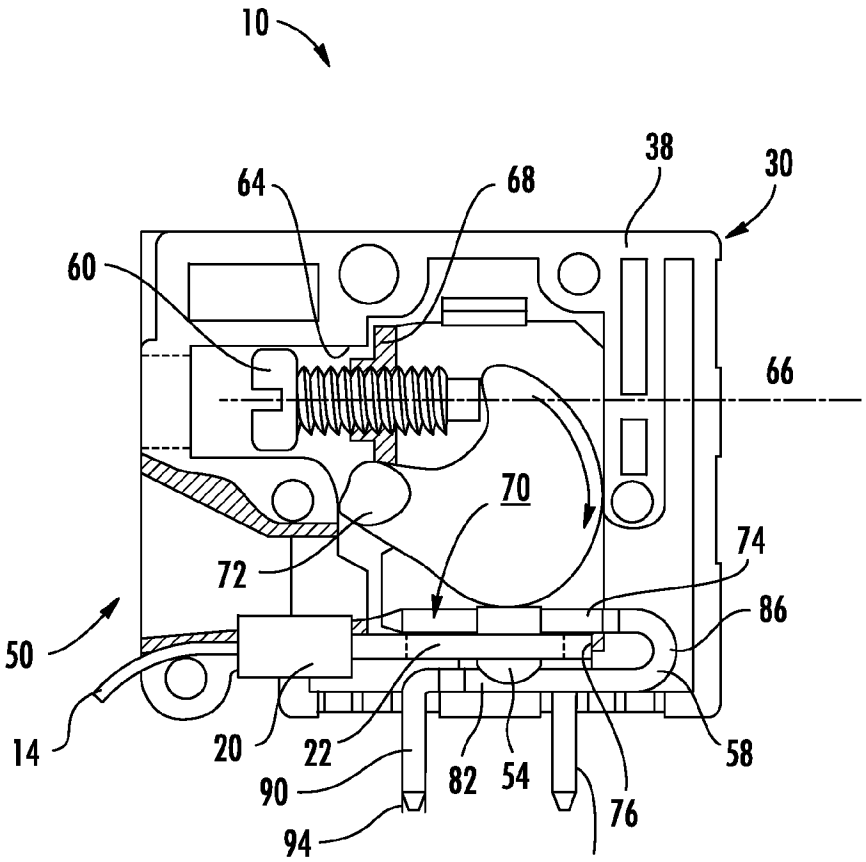
FIG. 4B is a section view of the terminal block of FIG. 3B taken on line 4B-4B.
Figure 4A:
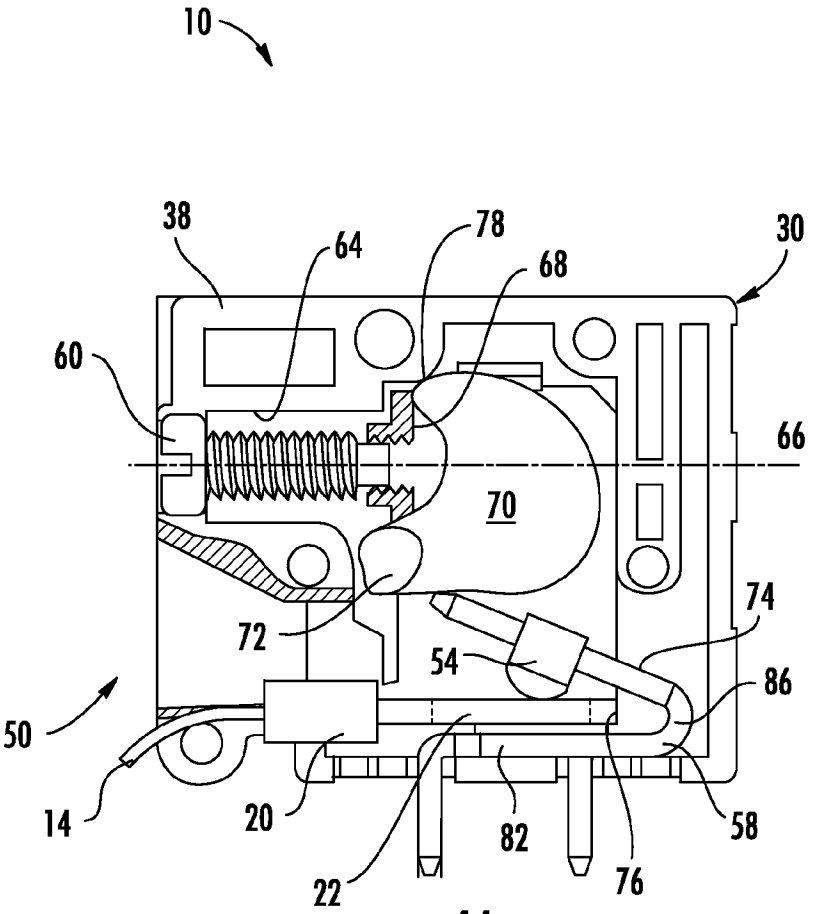
FIG. 4A is a section view of the terminal block of FIG. 3A taken on line 4A-4A.

FIG. 4A is a section view of the terminal block 10 of FIG. 3A taken on line 4A-4A, before the electrical conductor 14 is secured in the block 10. The threaded actuator member 60 is accommodated within a passage 64 in the terminal block 10, at an orientation generally parallel to a long axis 66 of the terminal block 10, generally perpendicular to the front wall 34, and parallel to the top wall 38, the side walls 42, 44, and the bottom wall 48. The actuator member 60 threads into a female threaded section 68 that is secured within the housing 30.

In FIG. 4A, the connection lug 54 is not engaged with the aperture 22 in the ring lug 20, so that the electrical conductor 14 is not connected to the terminal block 10. In the unconnected state the actuator member 60 has not been advanced into the housing 30 so as to pivot the cam member 70 and thus move the connection lug 54 into the aperture 22. As the actuator member 60 is threaded into the aperture 68 to secure the conductor 14 in the connection block 10, the end of the actuator member 60 translates along the long axis 66 of the housing 30 and comes into engagement with the cam member 70. The cam member 70 is pivotable about a pivot 72 so that as the actuator member 60 translates along the axis 66, the cam member 70 pivots away from the front wall 34 and downward toward the bottom wall 48. The spring arm 58 has a bias arm 74 that contacts and biases the cam member 70 to remain in contact with the actuator member 60. Threading the actuator member 60 into the aperture 68 opposes the spring arm 58 bias so as to force the connection lug 54 into the lug aperture 22. The bias arm 74 also supports the connection lug 54.

FIG. 4B is a section view of the terminal block of FIG. 3B taken on line 4B-4B. FIG. 4B illustrates the terminal block in its connected state, where the electrical conductor 14 is secured in place due to the connection lug 54 extending through the ring lug aperture 22, as well as by friction between the spring arm 58 and the ring lug 20.

Referring to FIGS. 4A and 4B, a method for connecting the electrical conductor 14 to the connection block 10 will be described. Referring to FIG. 4A, the electrical conductor 14 is inserted into the receiving aperture 50, along a direction generally parallel to the axis 66, so that the lug aperture 22 is in position to receive the connection lug 54. The receiving aperture 50 can terminate in a stop 76 against which the ring lug 20 abuts when the electrical conductor 14 is in its connection position. In this position, the cam member 70 is biased against a cam stop 78 by the bias arm 74, and the connection lug 54 is out of the path of the ring lug 20 so that the connection ring lug 20 can be introduced fully into the receiving aperture 50.

Referring to FIG. 4B, the actuator member 60 is threaded into the female threaded section 68 until it contacts and acts to pivot the cam member 70 about the pivot 72. As the cam member 70 pivots, it in turn causes the bias arm 74 to pivot towards a fixed, base portion 82 of the spring arm 58. The bias arm 74 pivots about a resilient bend 86 connecting the two portions 74, 82. The travel of the actuator member 60 and the cam member 70 may be configured to not only move the connection lug 54 through the ring lug aperture 22, but to also press the bias arm 74 down tightly onto the ring lug 20 so that it is securely fixed between the bias arm 74 and the base portion 82 of the spring arm 58. As shown in FIG. 4B, the connection lug 54 extends down into the base portion 82. The base portion 82 can include, for example, a recessed portion, or an aperture, that allows the connection lug 54 to extend partially into or wholly through the base portion 82. The base portion 82 can be fixed to, for example, the bottom wall 48, or fixed relative to some other section of the housing 30.

To disconnect the electrical conductor from the terminal block 10, the actuator member 60 is withdrawn out of the passage 64 so that the cam member 70 pivots away from the ring lug 20 under action of the spring arm 58 bias, causing the connection lug 54 to disengage from the ring lug aperture 22. The electrical conductor 14 can then be pulled from the receiving aperture 50 in a direction generally parallel to the long axis 66 of the connection block 10.

According to one aspect of the the present embodiments, the connection block 10 may be an electrical connection device intended to electrically connect the electrical conductor 14 to another component, system, hardware, or other electrically conductive infrastructure. In this embodiment, the electrical conductor 14 may be an insulated electrical conductor, and the spring arm 58 can be formed from a resilient and/or deformable electrical conductor such as a metal. Examples of suitable metallic materials include, copper, steel, aluminum, other metals, and alloys thereof.

The spring arm 58 can terminate at a connection pin 90 configured to plug into a larger component, system, or hardware, so as to be electrically connected to the conductor 14 through the connection block 10. A second pin 92 may be included and may or may not be electrically coupled to the spring arm 58. One or both of the pins 90, 92 may protrude from the bottom wall 48, or another wall of the housing 30. The housing 30, as well as the cam member 70, may be formed from electrically insulative materials such as plastics or other polymers so as to prevent current flow through the housing. The housing 30 has a generally rectangular parallelepipedal shape, but other geometric forms may be used.

In this specification, the term "pivot" is not to be construed to mean only circular motion. Other forms of rotational motion, including general curvilinear motions, are encompassed by the term. For example, the bias arm 74 pivots in response to the bias of the cam member 70, but its motion will not describe a perfect circular arc, and will instead undergo a general curvilinear motion.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A terminal block, comprising:

a housing having a front face;

a receiving aperture at the front face;

an actuator member mounted in the housing so as to be translatable therein;

a cam member mounted within the housing and configured to be pivotable about a pivot in response to translation of the actuator member; and a resilient member mounted within the housing and having a bias arm configured to be moved toward a connection portion of a conductor positioned within the receiving aperture, wherein the resilient member comprises a projection configured to engage an aperture of the connection portion.

2. The terminal block of claim 1, wherein the terminal block is capable of a connected position and a disconnected position, wherein in the connected position, the projection extends at least partially through the aperture of the conductor, and the actuator member exerts a bias force on the cam member so that the cam member in turn exerts a bias force on the bias arm.

3. The terminal block of claim 2, wherein the housing has a top wall, two side walls spaced from one another, and an axis extending from the front face of the housing toward a rear of the housing, wherein the actuator member is translatable within the housing in a direction generally parallel to the axis.

4. The terminal block of claim 3, wherein the cam member is mounted between the two side walls and is pivotable about an axis oriented transverse to the side walls.

5. The terminal block of claim 4, wherein the housing has a bottom wall and the resilient member is located between the bottom wall and the cam member.

6. The terminal block of claim 2, wherein the bias arm is configured to pivot in a clockwise direction as the cam member pivots in a counterclockwise direction.

7. The terminal block of claim 6, wherein the resilient member comprises a base portion connected to the bias arm by a bend of the resilient member and wherein the bias arm is pivotably mounted to the base portion at the bend.

8. The terminal block of claim 6, wherein the projection extends from the bias arm and faces the base portion.

9. The terminal block of claim 8, wherein when the terminal block is in the connected position, the connection portion of the electrical conductor is sandwiched between and in contact with the base portion and the bias arm.

10. The terminal block of claim 1, wherein the actuator member is a threaded member and the housing includes a threaded female section through which the actuator member advances.

11. The terminal block of claim 1, wherein the housing is formed of an insulative polymer material and the resilient member is metallic.

12. A terminal block, comprising:

an insulative housing having a front face, a top wall, two side walls spaced from one another, and an axis extending from the front face of the housing to a rear of the housing;

a receiving aperture at the front face adapted to receive a connection portion of a metallic conductor;

an actuator member mounted in the housing so as to be translatable therein;

a cam member mounted within the housing mounted between the two side walls and configured to be pivotable about a pivot oriented transverse to the side walls in response to translation of the actuator member; and a resilient member mounted within the housing and having a bias arm positioned to be moved toward the connection portion of the conductor, wherein the resilient member comprises a projection mounted on the bias arm configured to engage an aperture of the conductor positioned within the housing.

13. The terminal block of claim 12, wherein the terminal block is capable of a connected position and a disconnected position, wherein in the connected position, the projection extends through the aperture of the conductor, and the actuator member exerts a bias force on the cam member so that the cam member in turn exerts a bias force on the bias arm.

14. The terminal block of claim 13, wherein the housing has a bottom wall and the resilient member is located between the bottom wall and the cam member.

15. The terminal block of claim 14, wherein the bias arm is configured to pivot in a clockwise direction as the cam member pivots in a counterclockwise direction.

16. The terminal block of claim 15, wherein the resilient member comprises a base portion connected to the bias arm by a bend of the resilient member and wherein the bias arm is pivotably mounted to the base portion at the bend.

17. A method of connecting an electrical conductor having a connection portion to a terminal block, the method comprising:

providing a terminal block comprising a housing, a receiving aperture adapted to receive the connection portion, an actuator member mounted in the housing so as to be translatable therein, a cam member configured to be pivoted about a pivot in response to translation of the actuator member, and a resilient member mounted within the housing and having a bias arm with a projection thereon;

inserting the conductor into the receiving aperture; and advancing the actuator member through the housing, wherein the actuator pivots the cam member as the actuator advances, and the cam member moves the resilient member so that the projection engages an aperture in the connection portion to secure the electrical conductor in the terminal block.

18. The method of claim 17, wherein the resilient member comprises a metallic base portion connected to the bias arm and by a bend of the resilient member, the projection moving toward the base portion as the actuator member advances through the housing so that that connection portion becomes sandwiched between the base portion and the bias arm.

19. The method of claim 18, wherein the bias arm pivots in a clockwise direction as the cam member pivots in a counterclockwise direction.

20. The method of claim 19, wherein the housing has a top wall, two side walls spaced from one another, and an axis extending from the front face of the housing toward a rear of the housing, wherein advancing the actuator member comprises advancing the actuator member generally parallel to the long axis, and wherein the cam member is mounted between the two side walls and is pivotable about a pivot oriented transverse to the side walls.

* * * * *